US006170687B1

(12) United States Patent
Griffin et al.

(10) Patent No.: US 6,170,687 B1
(45) Date of Patent: Jan. 9, 2001

(54) APPARATUS PACKAGING ENCLOSURE

(75) Inventors: David C. Griffin; Dale T. Wiersema, both of Florence, SC (US)

(73) Assignee: The Esab Group, Inc., Florence, SC (US)

( * ) Notice: Under 35 U.S.C. 154(b), the term of this patent shall be extended for 0 days.

(21) Appl. No.: 09/588,370

(22) Filed: Jun. 6, 2000

(51) Int. Cl.[7] ..... A45C 13/00
(52) U.S. Cl. ..... 220/4.33; 220/9.1; 190/127
(58) Field of Search ..... 220/4.33, 9.1, 220/9.4, 23.91; 190/127

(56) References Cited

U.S. PATENT DOCUMENTS

| | | | | |
|---|---|---|---|---|
| 1,032,674 | | 7/1912 | Holland . | |
| 2,501,980 | * | 3/1950 | Wolfe | 220/4.33 |
| 2,517,757 | * | 8/1950 | Adlerstein | 220/9.1 X |
| 3,310,090 | * | 3/1967 | Balthes, Jr. | 220/9.1 |
| 4,374,555 | * | 2/1983 | March | 190/127 X |
| 4,529,069 | * | 7/1985 | March | 190/127 |
| 4,652,170 | | 3/1987 | Lew . | |
| 4,771,908 | | 9/1988 | McIntosh . | |
| 4,884,715 | | 12/1989 | Pohlmann . | |
| 5,260,853 | | 11/1993 | Yap et al. . | |
| 5,289,937 | * | 3/1994 | Boots | 220/9.1 |
| 5,335,805 | * | 8/1994 | Chen | 220/9.1 X |
| 5,351,847 | * | 10/1994 | Greenbaum | 220/9.1 |
| 5,406,050 | | 4/1995 | Macomber et al. . | |
| 5,450,285 | | 9/1995 | Schlemmer . | |
| 5,452,817 | | 9/1995 | Taravella et al. . | |
| 5,593,219 | | 1/1997 | Ho . | |
| 5,638,973 | | 6/1997 | Dewey et al. . | |
| 5,747,773 | | 5/1998 | Griffin et al. . | |
| 5,831,240 | | 11/1998 | Katooka et al. . | |

* cited by examiner

*Primary Examiner*—Steven Pollard
(74) *Attorney, Agent, or Firm*—Alston & Bird LLP

(57) ABSTRACT

An apparatus packaging enclosure includes end members (preferably injection molded plastic) of desired configuration to define a cross-sectional shape including a desired height and width to the packaging enclosure. Spaced-apart elongate fastener members (preferably extruded aluminum) extend longitudinally between the end members to define therewith a desired length to the packaging enclosure. Devices secure opposite ends of the fastening members to the inside surfaces of respective end members at generally outer peripheral areas of the end members. Elongate panels (preferably pultruded plastic) extend between the end members and around the outside of the fastener members to define outside surfaces of the packaging enclosure. Devices secure longitudinal edges of the panels to the fastener members. The panels are positioned within the edges an abutting relationship with inside surfaces of the end members. The panels are slightly longer in the longitudinal dimension than the fastener members, so that when the apparatus packaging enclosure is assembled and the fastener members are secured to the end members, the panels will be in compression and the fastener members will be in tension enhancing desired structural characteristics of the packaging enclosure.

8 Claims, 4 Drawing Sheets

APPARATUS PACKAGING ENCLOSURE

FIELD OF THE INVENTION

This invention relates to an enclosure for packaging and transporting apparatus and is particularly adapted for packaging and transporting a power supply for a welding torch or the like.

BACKGROUND AND OBJECT OF THE INVENTION

Various types of apparatus including power supplies for welding equipment, such as arc welders or plasma arc torches, are packaged or housed in enclosures for transportation and sometimes subsequent use from the enclosure. These power supplies are preferably housed in a packaging enclosure with handles thereon for transporting the enclosure with power supply apparatus therein from one place to the other and which has access openings therein so that the power supply may be connected to various other devices without removal from the enclosure.

A suitable apparatus packaging enclosure of this type, which has a rugged, modem, flexible design and which can be made in a number of different lengths without additional tooling costs, has not heretofore been available. Accordingly, there exist a need for such an apparatus packaging enclosure.

SUMMARY OF THE INVENTION

It has been found by this invention that the above object and need may be filled by providing an apparatus packaging enclosure constructed, generally, as follows.

End members are provided which have inside surfaces and which are of a desired configuration to define a cross-sectional shape including a desired height and width to the packaging enclosure. Spaced-apart elongate fastener members extend longitudinally between the end members to define therewith a desired length to the packaging enclosure. Means (preferably adjustable screw thread means) are provided to secure opposite ends of the fastener members to the inside surfaces of respective end members at generally outer peripheral areas of the end members. Elongate panels extend between the end members and around the outside of the fastener members to define outside surfaces of the packaging enclosure. Means (preferably tongue and groove means) are provided for securing longitudinal edges of the panels to the fastener members.

The panels are positioned with edges thereof in abutting relationship with the inside surfaces of the end members. The panels are slightly longer in longitudinal dimension than the fastener members, so that when the apparatus packaging enclosure is assembled, the panels will be in compression and the fastener members will be in tension. This relationship of compression and tension creates desirable structural characteristics for the packaging enclosure including stronger and stiffer outside panels.

Preferably, first and second fastener members are respectively positioned at the bottom corners of the packaging enclosure and the end members, and third and fourth fastener members are respectively positioned generally midway of the sides of the packaging enclosure and the end members. The flexible panels include a base panel, opposite side panels and a top panel. The first and second fastener members connect the base panel to the opposite side panels and the third and fourth fastener members connect the opposite side panels to the top panel.

The enclosure is preferably constructed with plastic end members which have been injection molded, aluminum fastener members which have been extruded, and plastic flexible panels which have been pultruded.

BRIEF DESCRIPTION OF THE DRAWINGS

Some of the objects and advantages of this invention have been set forth above; other objects and advantages will appear from the following detailed description of a preferred embodiment of the invention, when taken in conjunction with the accompanying drawings, in which.

DETAILED DESCRIPTION OF THE INVENTION

Figure 1:
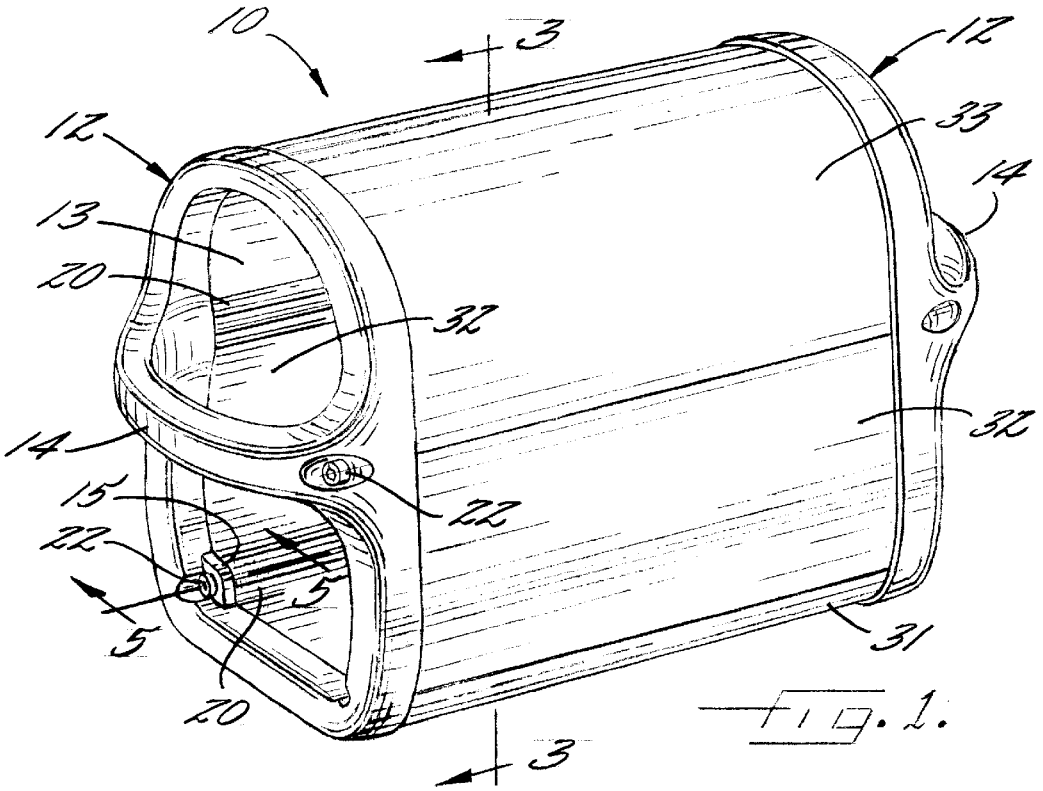
FIG. 1 is a perspective view of an apparatus packaging enclosure constructed in accordance with this invention.

The present invention now will be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete, and will fully convey the scope of the invention to those skilled in the art. Like reference numbers refer to like elements throughout.

There is illustrated an apparatus packaging enclosure, generally indicated at 10. This packaging enclosure 10 may be utilized for packaging and transporting any desired apparatus and is specifically designed for packaging and transporting a welding arc power supply such as utilized for arc welding or plasma arc tortures (not shown). The packaging enclosure 10 includes end members 12. These end members 12 are preferably injection molded plastic having an access opening 13 and a handle member 14. The end members also define inside surfaces generally indicated at 15. These injection molded plastic end members 13 may be constructed of any suitable plastic material and or preferably constructed of glass filled nylon which provides high strength, good impact characteristics, good electrical insulation and low costs.

Figure 2:
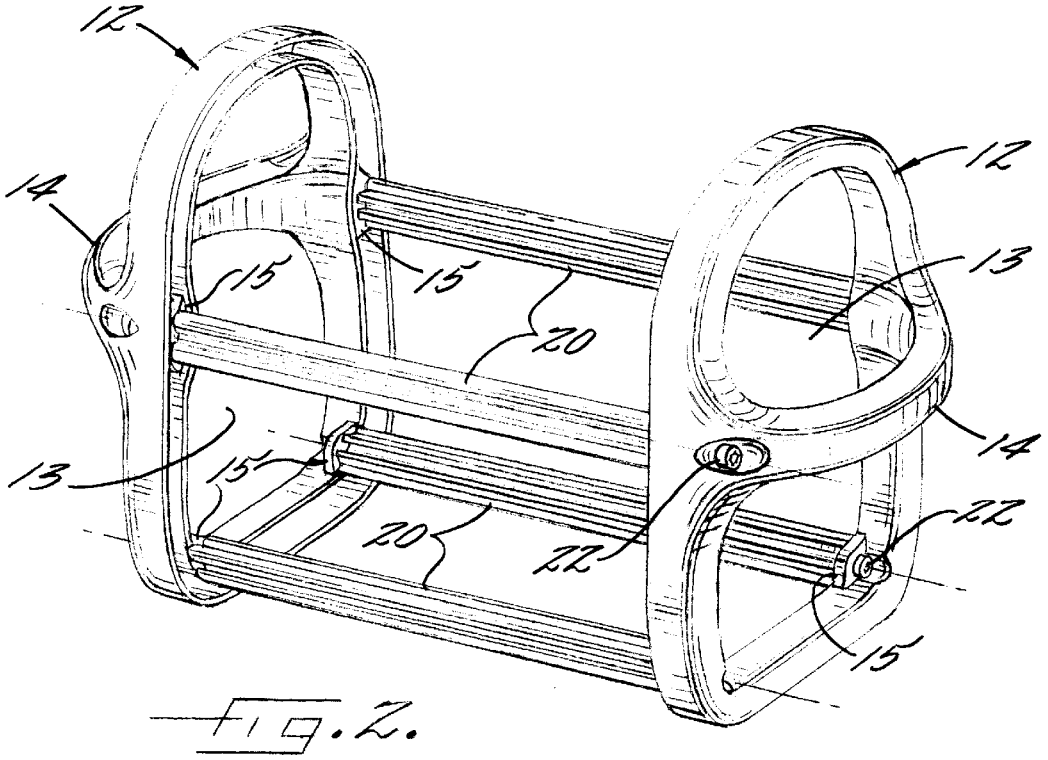
FIG. 2 is a perspective view of the apparatus packaging enclosure of FIG. 1 and which is taken from the other side thereof and in which the outer elongate flexible panels have been removed to illustrate the relationship between the end members and the elongate fastener members.
Figure 3:
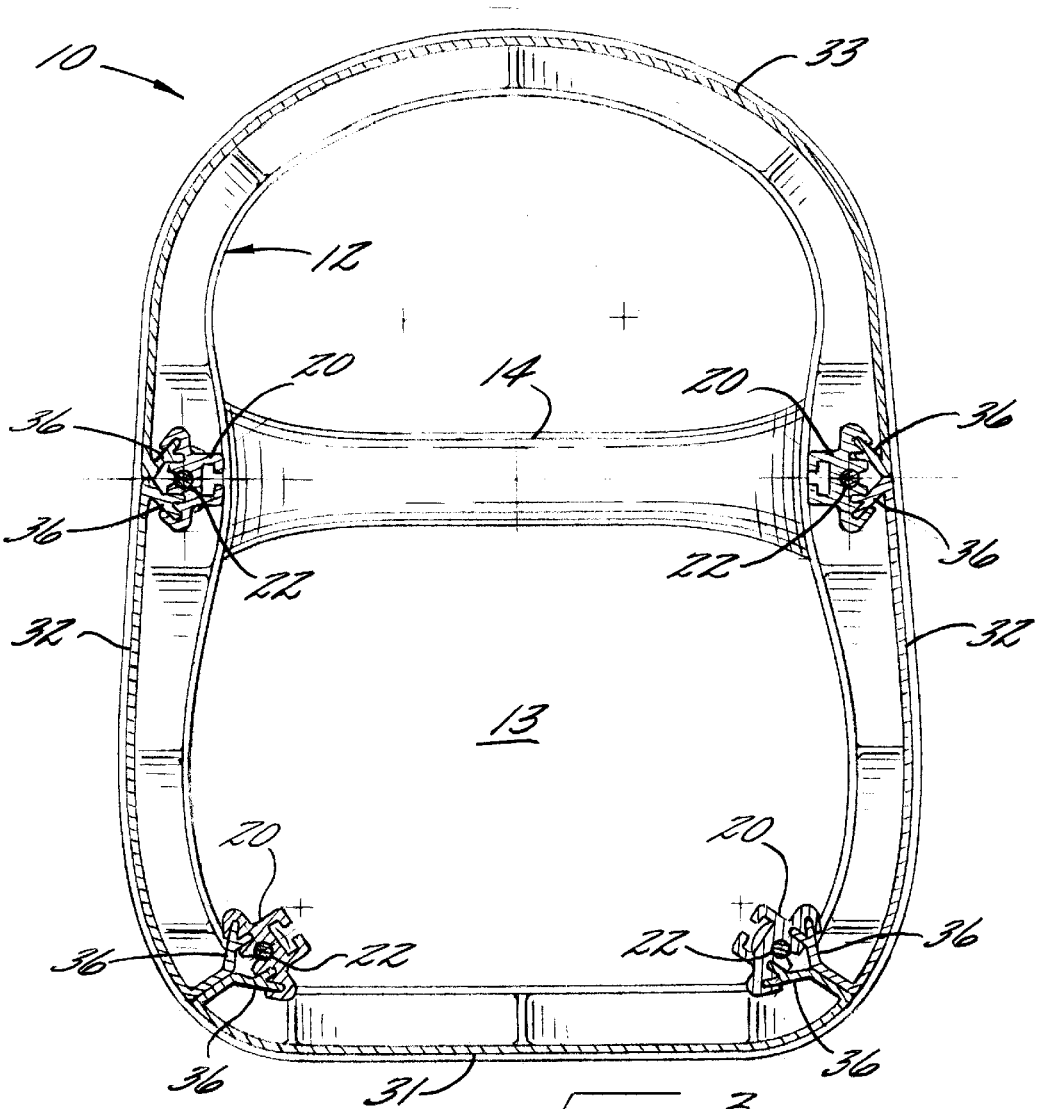
FIG. 3 is an enlarged sectional view taken generally along the line 3—3 of FIG. 2.

The packaging enclosure 10 further includes spaced-apart elongate fastener members 20 extending longitudinally between the end members 12 to define therewith a desired length to the packaging enclosure 10. Means, preferably in the form of screw thread means 22, secure opposite ends of the fastener members 20 to the inside surfaces 15 of the respective end members 12 at outer peripheral areas of the end members 12 (as shown particularly in FIGS. 2 and 3). These fastener members 20 are preferably extruded aluminum. First and second ones of these fastener members are respectfully positioned at the bottom comers of the packaging enclosure 10 and the end members 12 and third and fourth fastener members 20 are respectfully positioned generally midway of the sides of the packaging enclosure 10 and the end members 12 (as shown particularly in FIGS. 2 and 3). The use of extruded aluminum for the fastener members 20 provides lightweight structural members with low tooling and part cost. Also, extruded aluminum may be easily cut to any length to define a desired length to the packaging housing without the necessity of the use of other tooling when changing the length of the packaging enclosure 10.

The packaging enclosure 10 further includes elongate flexible panels, preferably in the form of a base panel 31, opposite side panels 32 and top panel 33. These panels 31, 32, 33 are preferably pultruded plastic and preferably are constructed of fiberglass which provides high strength, low weight, good electrical insulation, good vibration clamping and is well suited for pultruding.

Figure 4:
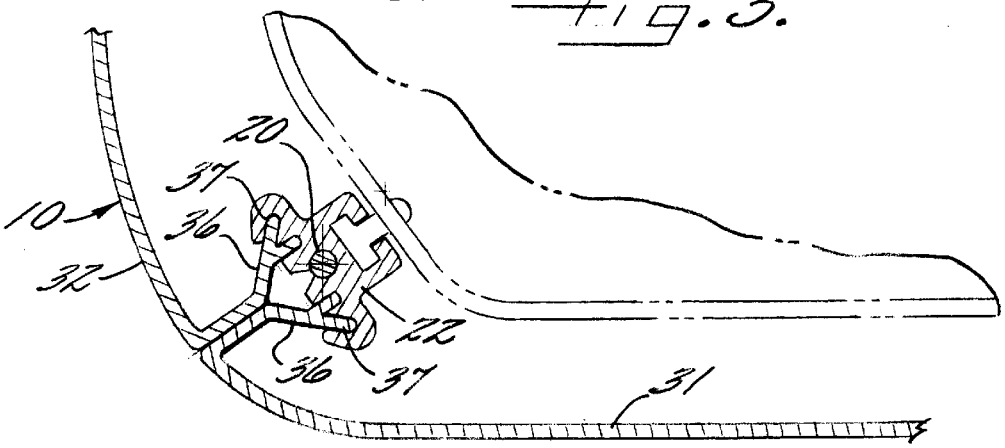
FIG. 4 is an enlarged partial sectional view of a lower left comer of the packaging enclosure as shown in FIG. 3 and illustrating a possible mounting of an apparatus therein which is shown in phantom lines.
Figure 6:
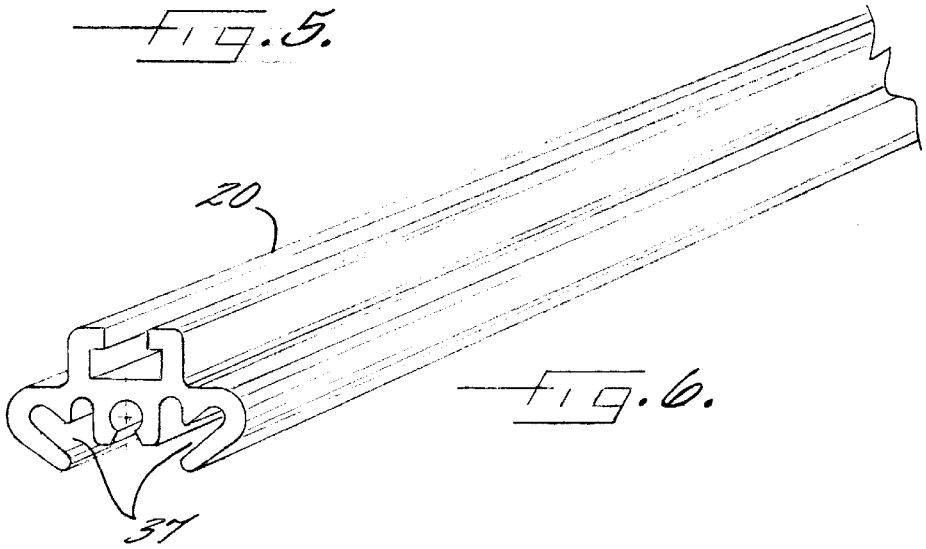
FIG. 6 is a partial perspective view of one of the elongate fastener members utilized in the apparatus packaging enclosure.
Figure 7:
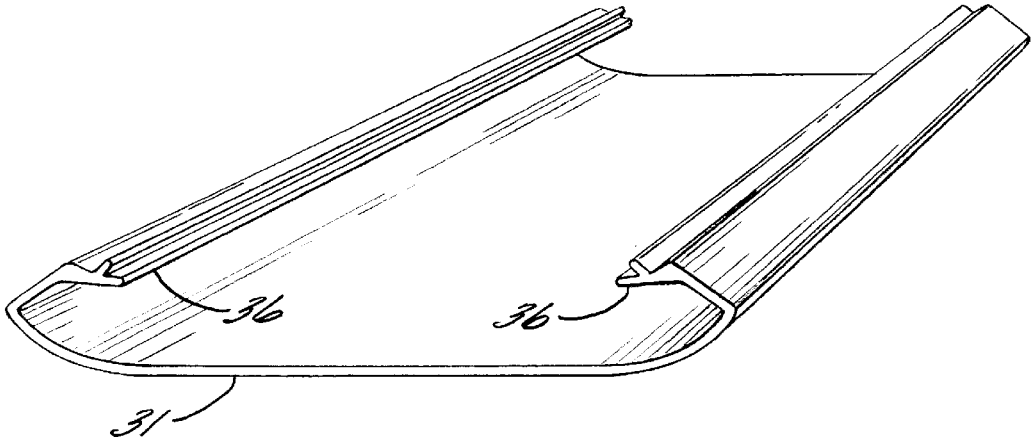
FIGS. 7, 8 and 9 are respective perspective views of a base panel, a top panel and one of the side panels utilized in the apparatus packaging enclosure of this invention.
Figure 8:
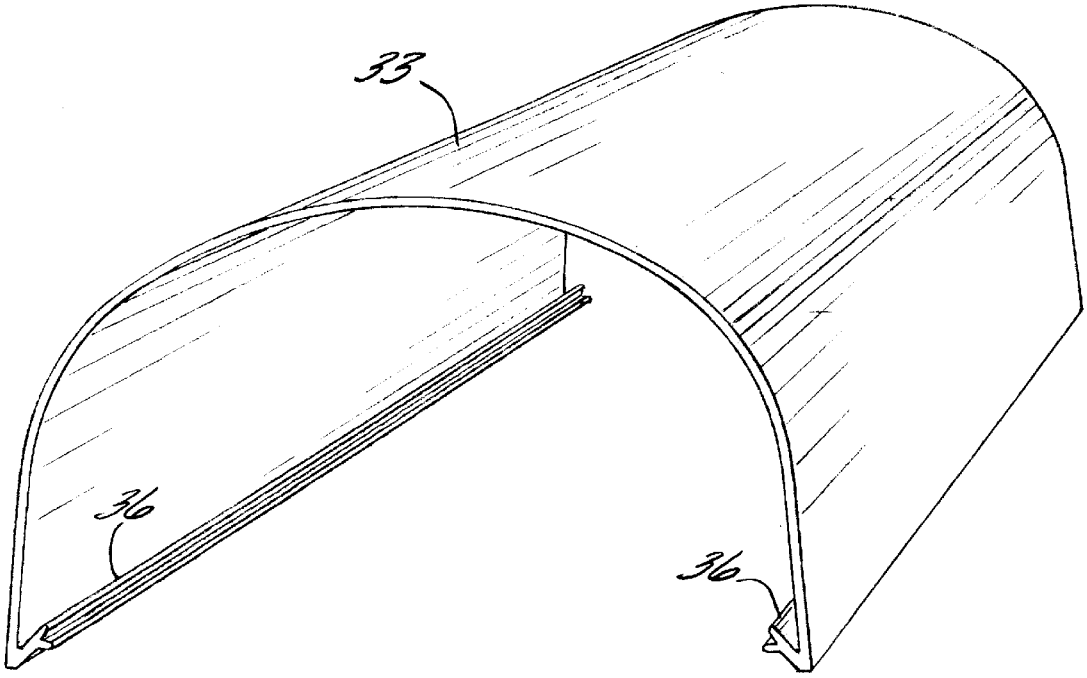
Figure 9:
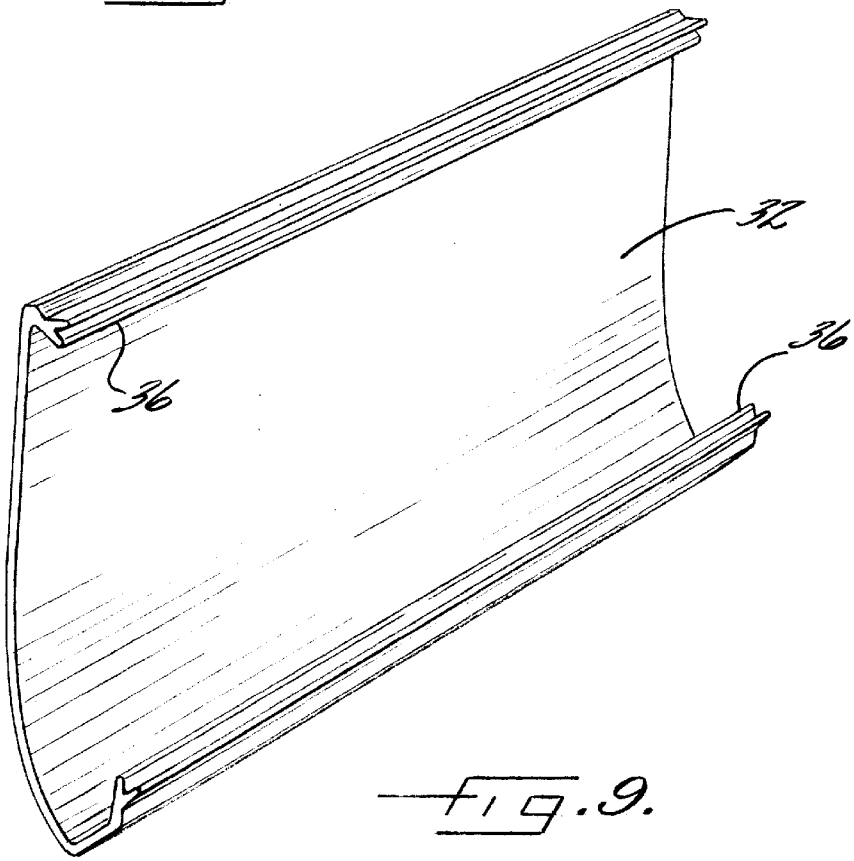

Tongue and groove securing means 36, 37 are provided for securing longitudinal edges of the panels 31, 32, 33 to the fastener members 20. Specifically, there is a tongue securing means on each longitudinal edge of each panel 31, 32, 33 (as shown in FIGS. 3, 7, 8 and 9) and there is provided double groove securing means 37 on each of the fastener members 20 (as shown particularly in FIGS. 3, 4 and 6). These tongues securing means 36 are secured within grooves securing means 37 in the manner shown particularly in FIGS. 3 and 4. The fastener members 20 may also include a third groove securing means for receiving a tongue securing means on the apparatus packaged within the packaging enclosure 10 (as shown in phantom lines in FIG. 4).

Figure 5:
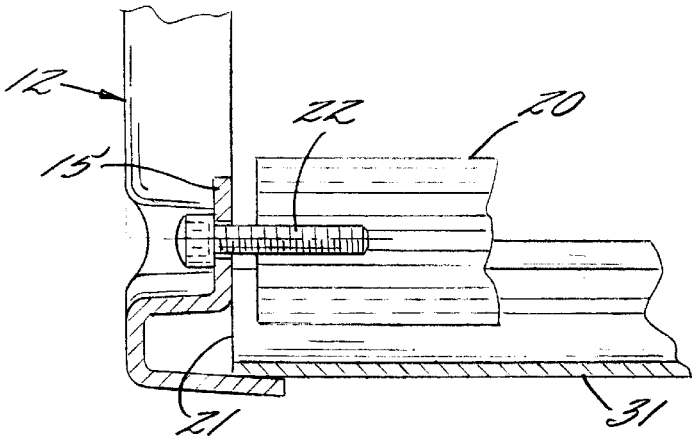
FIG. 5 is a partial sectional view through one comer of the apparatus packaging enclosure and taken generally along the line 5—5 of FIG. 1.

The panels 31, 32, 33 are positioned with edges 21 in abutting relationship with the inside surfaces 15 of each of the end members 12 (as shown particularly in FIG. 5). The panels 31, 32, 33 are slightly longer in longitudinal dimension than the fastener members 20 (as shown in FIG. 5) so that when the apparatus packaging enclosure 10 is assembled and the screw thread securing means 22 is adjusted or tightened up, the panels 31, 32, 33 will be put in compression and the shorter fastener members 20 will be put in tension. Compression of the panels 31, 32, 33 and tension of the fastener members 20 create a stiffness and strength for the packaging enclosure 10 which enhances the desired structural characteristics of the packaging enclosure 10.

Thus it may be seen, that the above described construction of an apparatus packaging enclosure 10 provides desired characteristic to this type of packaging enclosure which have not here to full been available and provides the flexibility of manufacturing various lengths of such a packaging enclosure without the necessity of changing tooling in the manufacture.

Many modifications and other embodiments of the invention will come to mind to one skilled in the art to which this invention pertains and having the benefit of the teachings presented in the foregoing descriptions and the associated drawings. Therefore, it is to be understood that the invention is not to be limited to the specific embodiment disclosed and that modifications and other embodiments are intended to be included within the scope of the appended claims. Although specific terms are employed herein, they are used in a generic and descriptive sense only and not for purposes of limitation.

That which is claimed:

1. An apparatus packaging enclosure comprising:

end members having inside surfaces and having a desired configuration to define a cross-sectional shape including a desired height and width to said packaging enclosure;

spaced-apart elongate fastener members extending longitudinally between said end members to define therewith a desired length to said packaging enclosure; means securing opposite ends of said fastener members to said inside surfaces of respective end members at generally outer peripheral areas of said end members;

elongate flexible panels extending between said end members and around the outside of said fastener members to define outside surfaces of said packaging enclosure; means securing longitudinal edges of said panels to said fastener members; and said panels being positioned with end edges thereof in abutting relationship with said inside surfaces of said end members, and said flexible panels being slightly longer in longitudinal dimension than said fastener members, so that when said apparatus packaging enclosure is assembled and said fastener members secured to said end members by said securing means, said panels will be in compression and said fastener members will be in tension enhancing desired structural characteristics of said packaging enclosure.

2. An apparatus packaging enclosure, as set forth in claim 1, in which said means securing opposite ends of said fastener members to said end members comprise adjustable securing means for adjusting the compression of said flexible panels and the tension of said fastener members.

3. An apparatus packaging enclosure, as set forth in claim 1, in which said means securing longitudinal edges of said flexible panels to said fastener members comprise respective tongue and groove members on said panels and on said fastener members.

4. An apparatus packaging enclosure, as set forth in claim 3, in which said fastener members comprise first and second fastener members respectively positioned at bottom comers of said packaging enclosure and third and fourth fastener members respectively positioned generally midway of sides of said packaging enclosure; in which said flexible panels comprise a base panel, opposite side panels and a top panel; and in which said first and second fastener member connect said base panel to said opposite side panels and said third and fourth fastener members connect said opposite side panels to said top panel.

5. An apparatus packaging enclosure, as set forth in claim 1, 2, 3 or 4, in which said end members comprise injection molded plastic end members, said elongate fastener members comprise extruded aluminum fastener members, and said elongate flexible panels comprise pultruded plastic panels.

6. An apparatus packaging enclosure, as set forth in claim 5, in which said injection molded plastic end members comprise glass filled nylon, and in which said pultruded plastic panels comprise fiberglass.

7. An apparatus packaging enclosure comprising:

injection molded plastic end members having access openings therethrough, a handle member thereon and inside surfaces, said end members being of a desired configuration to define a cross-sectional shape including a desired height and width for said packaging enclosure;

four elongate extruded aluminum fastener members extending longitudinally between said end members to define a desired length to said packaging enclosure, first and second fastener members being respectively positioned at bottom comers of said packaging enclosure and third and fourth fastener members being respectively positioned generally midway of sides of said packaging enclosure;

adjustable screw thread means securing opposite ends of said fastener members to said inside surfaces of respective end members at outer peripheral areas of said end members elongate flexible pultruded plastic base panel, opposite side panels and top panel extending between said end members and around the outside of said fastener members to define outside surfaces of said packaging enclosure;

tongue securing means on each longitudinal edge of each of said pultruded plastic panels and double groove securing means on each of said fastener members cooperating with each other to secure longitudinal edges of said pultruded plastic panels to said fastener members, and in which said first and second fastener members connect said base panel to said opposite side panels and said third and fourth fastener members connect said opposite side panels to said top panel; and said panels being positioned with end edges thereof in abutting relationship with said inside surfaces of said end members, and said panels being slightly longer in longitudinal dimension than said fastener members so that, when said apparatus packaging enclosure is assembled and said screw thread securing means is adjusted, said panels will be in compression and said fastener members will be in tension enhancing desired structural characteristics of said packaging enclosure.

8. An apparatus packaging enclosure, as set forth in claim 7, in which said injection molded plastic end members comprise glass filled nylon, and in which said pultruded plastic panels comprise fiberglass.

* * * * *

UNITED STATES PATENT AND TRADEMARK OFFICE

CERTIFICATE OF CORRECTION

PATENT NO. : 6,170,687

DATED : January 9, 2001

INVENTOR(S) : Griffin et al.

It is certified that error appears in the above-identified patent and that said Letters Patent is hereby corrected as shown below:

Column 2, line 26, "comer" should read --corner--.

Column 3, line 7, "comers" should read --corners--.

Column 4, line 40, "comers" should read --corners--.

Column 5, line 3, "comers" should read --corners--; line 10, begin new paragraph with "elongate".

Signed and Sealed this

Eighth Day of May, 2001

*Attest:*

Nicholas P. Godici

NICHOLAS P. GODICI

*Attesting Officer*

*Acting Director of the United States Patent and Trademark Office*